US006152687A

United States Patent [19]

Wilhelm et al.

[11] Patent Number: 6,152,687

[45] Date of Patent: Nov. 28, 2000

[54] FEED PUMP

[75] Inventors: Dieter Wilhelm, Bebra; Egbert Lorenz, Wildeck; Peter Schuchardt, Rotenburg; Matthias Staab, Heinebach; Thomas Werner, Nentershhausen, all of Germany

[73] Assignee: Mannesman VDO AG, Germany

[21] Appl. No.: 09/284,562

[22] PCT Filed: Oct. 1, 1997

[86] PCT No.: PCT/EP97/05403

§ 371 Date: Jun. 11, 1999

§ 102(e) Date: Jun. 11, 1999

[87] PCT Pub. No.: WO98/17916

PCT Pub. Date: Apr. 30, 1998

[30] Foreign Application Priority Data

Oct. 23, 1996 [EP] European Pat. Off. ..... 97/05403

[51] Int. Cl.[7] ..... F04D 5/00

[52] U.S. Cl. ..... 415/55.1; 415/55.5

[58] Field of Search ..... 415/55.1–55.7

[56] References Cited

U.S. PATENT DOCUMENTS

| | | | |
|---|---|---|---|
| 4,591,311 | 5/1986 | Matsuda et al. | 415/55.5 |
| 5,284,417 | 2/1994 | Yu | 415/55.1 |
| 5,486,087 | 1/1996 | Treiber et al. | 415/55.1 |
| 5,551,835 | 9/1996 | Yu et al. | 415/55.1 |
| 5,558,490 | 9/1996 | Dobler et al. | 415/55.1 |

FOREIGN PATENT DOCUMENTS

| | | |
|---|---|---|
| 4036309 | 5/1991 | Germany . |
| 4343078 | 6/1995 | Germany . |
| 19607573 | 10/1996 | Germany . |
| 2263503 | 7/1993 | United Kingdom . |

*Primary Examiner*—Edward K. Look
*Assistant Examiner*—Rhonda Barton
*Attorney, Agent, or Firm*—Mayer, Brown & Platt

[57] ABSTRACT

In a feed pump designed for feeding fuel in a motor vehicle and having two feed chambers (11, 12) located opposite one another, of which one is connected to an inlet port (18) and the other to an outlet port (19), the feed chamber (11) connected to the inlet port (18) has a calming region (21) which a compression region (22) adjoins. Fuel entering the feed pump is thereby first calmed. Subsequently, in particular, gas bubbles present in hot fuel are dissolved due to the vapour pressure in the fuel being exceeded.

7 Claims, 2 Drawing Sheets

FEED PUMP

BACKGROUND OF THE INVENTION

Field of the Invention

The invention relates to a feed pump with a driven impeller which rotates in a pump casing and which has, on at least one of its end faces, a ring of guide vanes delimiting vane chambers, and with at least one part-annular channel which is arranged in the pump casing in the region of the guide vanes and which forms, with the vane chambers, a feed chamber provided for feeding a liquid from an inlet port to an outlet port and has a compression region with a cross section tapering over a limited angular sector.

Such feed pumps are known as peripheral or side-channel pumps and are often used for feeding fuel from a fuel tank to an internal combustion engine of a motor vehicle. In this case, the guide vanes generate in the feed chamber a circulating flow which runs transversely to the direction of movement of the guide vanes. The compression region serves for increasing the pressure in the feed chamber. As a result, gas bubbles of vaporous fuel which are present in the hot fuel condense in the liquid fuel due to the vapour pressure being exceeded. This is important, for example during hot-starting of the motor vehicle, since, in this case, the temperature of the fuel is particularly high and gas bubbles are therefore very often sucked in through the inlet port. Cold fuel, which usually does not contain any gas bubbles, is likewise to be conveyed reliably by means of the feed pump.

In a feed pump known from practice, the compression region is located directly at that region of the part-annular channel which adjoins the inlet port. The fuel thereby flows from the inlet port directly into the compression region and generates turbulence there. However, this turbulence has regions with high and low pressures and consequently prevents the gas bubbles from being dissolved reliably. Furthermore, in this feed pump, there is the risk of cavitation in the compression region, particularly on the wall of the part-annular channel. This cavitation eventually leads to destruction of the wall of the part-annular channel and to a reduced delivery of the feed pump.

A further fuel pump is known, which has a region of constantly changing cross section between the inlet port and the compression channel (DE 196 07 573 A1). The gas contained in the fuel is led radially inwards by displacement, collected in pockets and discharged via a degassing bore.

Another known fuel pump possesses an elongate vapour channel, the cross section of which is reduced in the last section (U.S. Pat. No. 5,284,417). In this case, the reduction in cross section is designed in such a way that it leads to a degassing bore. The fuel/gas mixture carried in the elongate vapour channel is thus led to the degassing bore, so that the gas is discharged via this bore.

Another feed pump has become known, in which that region of the part-annular channel which adjoins the inlet port has initially a first region with a constant cross section. At the end of this region, a degassing bore is worked into the pump casing at the radially inner end of the part-annular channel. The cross section of the part-annular channel subsequently decreases abruptly, the said channel then being led with a constant cross section as far as the region of the outlet port (U.S. Pat. No. 4,591,311). In this case, the gas bubbles are not condensed in the fuel, but are to be discharged through the degassing bore. Since the circulating flow is already forming in the first region, the gas bubbles are entrained by the fuel and form a foam with the liquid fuel. This rules out a reliable separation of gas bubbles and fuel and, consequently, discharge of the gas bubbles through the degassing bore. Furthermore, the fraction of gas bubbles in the fuel to be conveyed is exposed to pronounced time fluctuations, the result of this, particularly in the region of the abrupt changing cross section of the part-annular channel, being cavitation on the pump casing and, consequently, a decrease in the delivery of the feed pump.

The problem on which the invention is based is to design a feed pump of the type mentioned in the introduction, in such a way that gas bubbles present in the fuel are condensed particularly reliably and that, if possible, no cavitation occurs in the region of the part-annular channel.

BRIEF SUMMARY OF THE INVENTION

This problem is solved, according to the invention, in that the part-annular channel has a calming region of constant cross section between the inlet port and the compression region.

By virtue of this design, the fuel sucked in through the inlet port first enters the calming region, in which turbulence introduced into the feed chamber through the inlet port can decay. After the turbulence has decayed, the fuel, together with the gas bubbles, enters the compression region, in which the gas bubbles condense in the fuel reliably due to their vapour pressure being exceeded. Since the turbulence of the fuel is first eliminated in the calming region, the risk of cavitation of the wall of the part-annular channel is kept as low as possible and a uniform delivery of the feed pump is ensured.

The invention is suitable, in particular, also for a feed pump in which there are arranged on both sides of the impeller feed chambers which have a connection for the overflow of the liquid from one feed chamber into the other feed chamber, the inlet port opening into one feed chamber and the other feed chamber opening into the outlet port. Such a feed pump is often used to obtain a high delivery along with particularly small dimensions. According to an advantageous development of the invention, in the case of cold and hot fuel, the feed pump has a particularly high delivery when the part-annular channel of the feed chamber opening into the outlet port has a cross-sectional widening which is continuous, as seen in the direction of movement of the guide vanes, and which extends essentially over the same angular sector as the calming region of the part-annular channel of the other feed chamber.

According to another advantageous development of the invention, the turbulence of the fuel flowing in through the inlet port decays particularly reliably when the calming region extends over an angular sector of approximately 50°.

According to another advantageous development of the invention, the gas bubbles in the fuel condense particularly reliably in the fuel when the compression region extends over an angular sector of approximately 70°.

In the known feed pumps, the fuel flowing into the part-annular channel from the inlet port impinges virtually perpendicularly onto the guide vanes. Additional turbulence is generated as a result. According to another advantageous development of the invention, this turbulence can be avoided in a simple way if there is arranged in the region of the inlet port a flow guide vane which is designed for introducing the liquid to be pumped into the calming region of the feed chamber in the tangential direction.

The flow guide vane could be designed as a component to be inserted separately into the inlet port. However, according to another advantageous development, the feed pump consists of particularly few components which can be manufactured cost-effectively, if the flow guide vane is manufactured in one piece with the pump casing and is arranged on that side of the inlet port which faces away from the part-annular channel.

A contribution is made to the further calming of the fuel flowing into the part-annular channel if, according to another advantageous development of the invention, the transition of the inlet port into the calming region of the part-annular channel is rounded on the side located opposite the flow guide vane.

According to another advantageous development of the invention, in the case of a feed pump not yet filled with fuel, air located in the part-annular channel can escape in a simple way if the part-annular channel has, at the end of the compression region, a vent bore which passes through the pump casing.

The cross-sectional widening of the part-annular channel leading to the outlet port could be produced, for example, by means of a continuous depression, with the part-annular channel having a constant width.

According to another advantageous development of the invention, however, a circulating flow forms particularly quickly in this part-annular channel if the cross-sectional widening of the part-annular channel leading to the outlet port is produced by means of a broadening of the part-annular channel. The delivery of the feed pump is additionally increased thereby.

The delivery of the feed pump can be increased even further if the cross-sectional widening is produced by means of a radially inner delimitation of the part-annular channel, the said delimitation being led inwards, as seen in the direction of flow, whilst at the same time there is a continuous depression. By virtue of this design, the circulating flow forms first in the radially outer region of the guide vanes, where the pressure is, in any case, at its highest due to the centrifugal forces generated by the guide vanes.

DESCRIPTION OF THE DRAWINGS

The invention permits numerous embodiments. To illustrate further its basic principle, one of these is illustrated in the drawing and is described below. In the drawing.

DETAILED DESCRIPTION OF THE INVENTION

Figure 1:
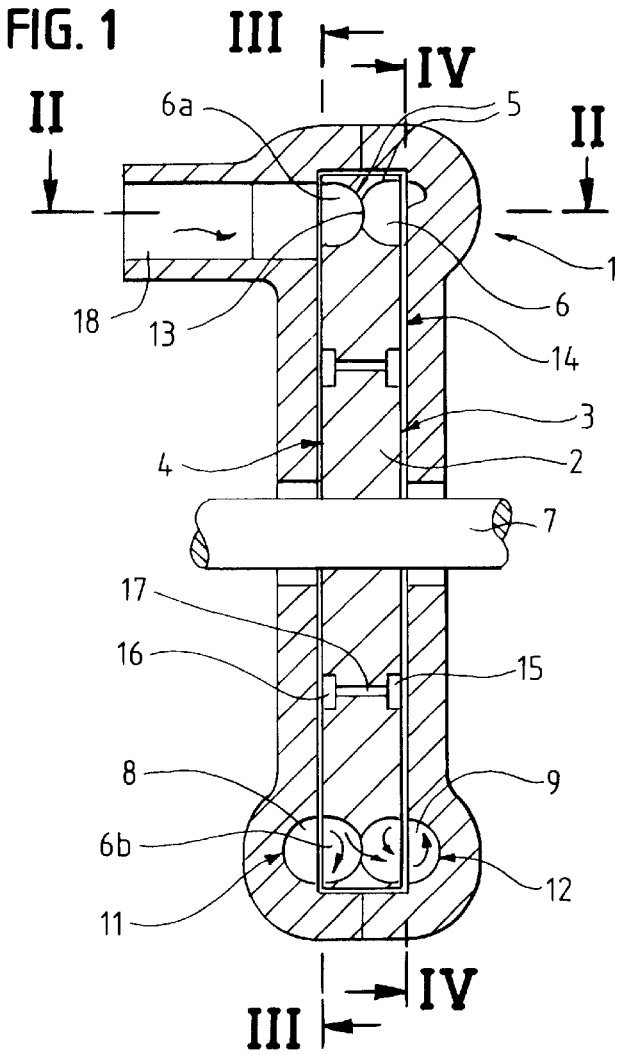
FIG. 1 shows a longitudinal section through a feed pump according to the invention.

FIG. 1 shows a longitudinal section through a feed pump according to the invention designed as a side-channel pump and having a pump casing 1. An impeller 2 is arranged rotatably in the pump casing 1. A ring 5 of guide vanes 6, 6*a*, 6*b* is worked into each of the two end faces 3, 4 of the impeller 2. The impeller 2 is fastened fixedly in terms of rotation, at its centre, on a drive shaft 7. The pump casing 1 has a part-annular channel 8, 9 on each of the two sides in the region of the guide vanes 6, 6*a*, 6*b*. The part-annular channels 8, 9, together with vane chambers 10, 10*a*, 10*b* illustrated in FIG. 2 and located between the guide vanes 6, 6*a*, 6*b*, form feed chambers 11, 12. When the impeller 2 rotates, circulating flows of a liquid to be conveyed occur in the feed chambers 11, 12. The circulating flows are marked by arrows in FIGS. 1 and 2 for illustration. The feed chambers 11, 12 have a connection 13 to one another which is made by overlapping the semi-circular cross sections of the vane chambers 10, 10*a*, 10*b*. As a result of this connection 13, liquid can overflow from one feed chamber 11 into the other feed chamber 12 virtually without any turbulence.

In its radially outer region and on its end faces 3, 4, the impeller 2 is located opposite the pump casing 1 with a slight clearance. This results in a sealing gap 14 which runs round the impeller 2 and seals off the feed chambers 11, 12.

A plurality of depressions 15, 16 located opposite one another are worked in the end faces 3, 4 of the impeller 2 in its radially inner region, as seen from the guide vanes 6, 6*a*, 6*b*. In each case two mutually opposite depressions 15, 16 are connected to one another by means of a duct 17. A small leakage quantity of the liquid to be conveyed passes through the sealing gap 14 between the impeller 2 and the pump casing 1 to the depressions 15, 16. The depressions 15, 16 thereby form axial sliding bearings for the impeller 2. When the feed pump is in operation, therefore, the impeller 2 floats without friction on a liquid film.

Figure 2:
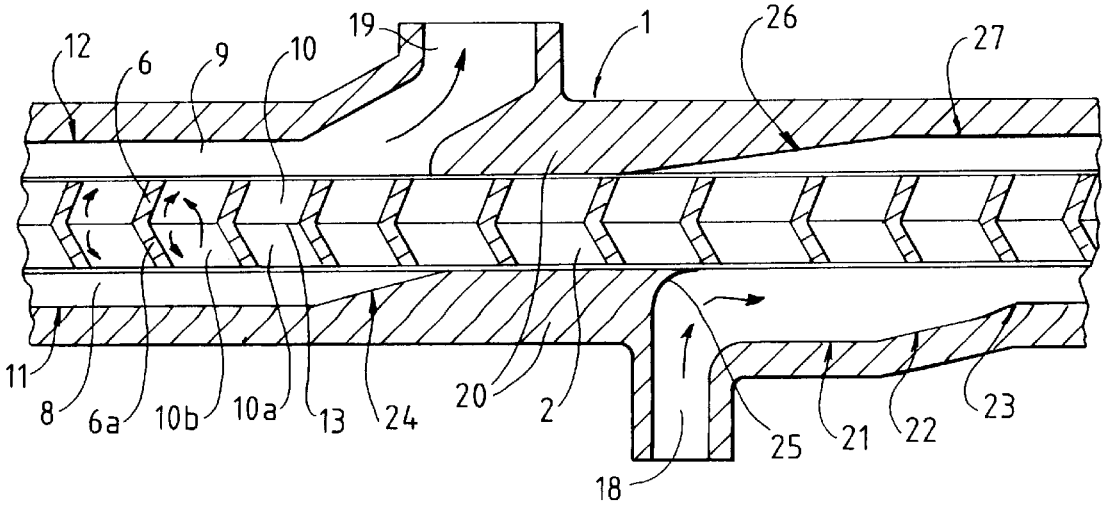
FIG. 2 shows a tangential section through the feed pump of FIG. 1 along the line II—II.

FIG. 2 shows a tangential section through the feed pump according to the invention from FIG. 1 along the line II—II. In order to make the drawing clearer, the feed chambers 11, 12 and the impeller 2 are drawn, stretched out, in the region of the guide vanes 6, 6*a*, 6*b*. The pump casing 1 has an inlet port 18 and an outlet port 19 which are separated from one another by a sill 20 arranged on both sides of the impeller 2. The sill 20 interrupts the circulating flows of liquid to be conveyed which are generated in the feed chambers 11, 12. The inlet port 18 opens into one feed chamber 11, whilst the other feed chamber 12 opens into the outlet port 19.

The part-annular channel 8 of the feed chamber 11, into which the inlet port 18 opens, has, on the entry side, a calming region 21 that starts at the inlet port and extends to an adjoining compression region 22. The compression region 22 reduces the cross section of the part-annular channel 8 by approximately half. The compression region 22 has adjoining it a feed region 23 of constant cross section which opens into an end region 24 directly upstream of the sill 20. Arranged in the inlet port 18 is a flow guide vane 25 which is manufactured in one piece with the pump casing 1. The part-annular channel 9 of the feed chamber 12 opening into the outlet port 19 has, on the entry side, as seen in the direction of flow, a cross-sectional widening 26 which extends over the same angular sector as the calming region 21 of the other part-annular channel 8. A feed region 27 of constant cross section adjoins the cross-sectional widening 26.

Figure 3:
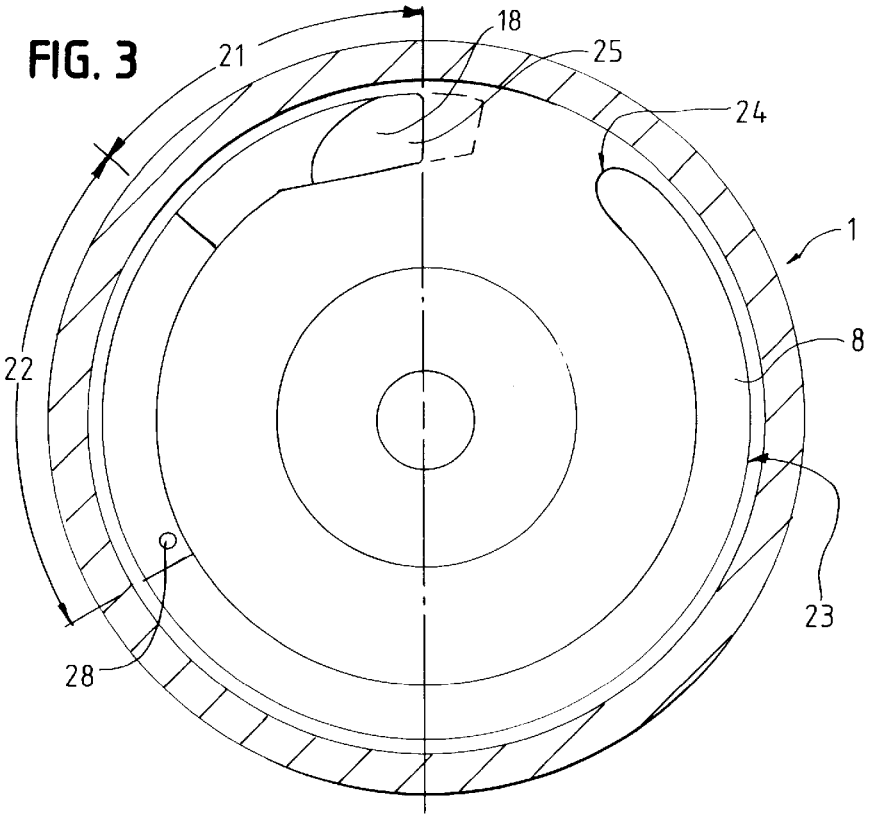
FIG. 3 shows a sectional illustration through the feed pump along the line III—III of FIG. 1.

FIG. 3 shows the part-annular channel 8, into which the inlet port 18 opens, in a sectional illustration along the line III—III from FIG. 1. In this view, the inlet port 18 is half-covered by the flow guide vane 25. The calming region 21 of the part-annular channel 8 extends approximately over an angular sector of 50°, the compression region 22 adjoining the said channel approximately over an angular sector of 70°. At the end of the compression region 22, a vent bore 28 passes through the pump casing 1. This vent bore 28 serves mainly for venting the feed pump when it is filled for the first time.

Figure 4:
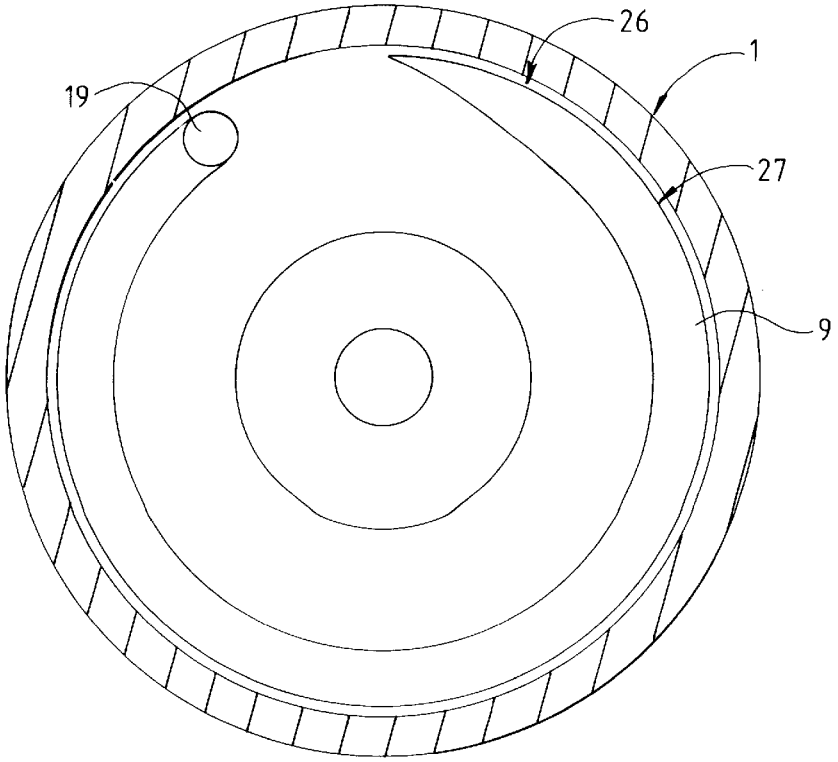
FIG. 4 shows a sectional illustration through the feed pump along the line IV—IV of FIG. 1.

FIG. 4 shows the part-annular channel 9 opening into the outlet port 19. It can be seen clearly that the radially outer delimitation of the part-annular channel 9 has a radius which is constant over the entire angular sector. The cross-sectional widening 26 at the start of the part-annular channel 9 is produced by the radially inner delimitation.

What is claimed is:

1. A liquid fuel feed pump with a driven impeller (2) which rotates in a pump casing (1) and which has, on at least one of it's end faces (3,4), a ring of guide vanes **(6, 6*a*, 6*b*) delimiting vane chambers (10, 10*a*, 10*b*), and with part-annular channels (8, 9) which is arranged in the pump casing (1) in the region of the guide vanes (6, 6*a*, 6*b*), and which forms, with the vane chambers (10, 10*a*, 10*b*) a feed chamber (11, 12) providing for feeding a liquid from an inlet port (18) to an outlet port (19) and has a compression region (22) with a cross section tapering over a limited angular sector, characterized in that the part-annular channels have a calming region (21) extending over an angular sector of about 50°, starting at the inlet port (18) which is then followed by a compression region (22)** that extends over an angular sector of about 70°.

2. Feed pump according to claim 1, characterized in that there are arranged on both sides of the impeller (2) feed vanes **(10, 10*a*, 10*b*) which have a connection for the overflow of the liquid from one feed chamber (11) into the other feed chamber (12), the inlet port (18) opening into one feed chamber and the other feed chamber (11) opening into the outlet port (19), and in that the part-annular channel (9) of the feed chamber (12) opening into the outlet port (19) has a cross-sectional widening (26) which is continuous, as seen in the direction of movement of the guide vanes (6), and which extends essentially over the same angular sector as the calming region (21) of the part-annular channel (8) of the other feed chamber (11)**.

3. Feed pump according to claim 1, characterized in that there is arranged in the region of the inlet port (18) a flow guide vane (25) which is designed for introducing the liquid to be pumped into the calming region (21) of the feed chamber (11) in the tangential direction.

4. Feed pump according to claim 3, characterized in that the flow guide vane (25) is manufactured in one piece with the pump casing (1) and is arranged on that side of the inlet port (18) which faces away from the part-annular channel (8).

5. Feed pump according to claim 3 or 4, characterized in that the transition of the inlet port (18) into the calming region (21) of the part-annular channel (8) is rounded on the side located opposite the flow guide vane (25).

6. Feed pump according to claim 1, 2 or 3, characterized in that the part-annular channel (8) has, at the end of the compression region (22), a vent bore (28) which passes through the pump casing (1).

7. Feed pump according to claim 2, characterized in that the cross-sectional widening (26) of the part-annular channel (9) leading to the outlet port (19) is produced by means of a broadening of the part-annular channel (9).

* * * * *